US007210911B2

(12) United States Patent
Ota et al.

(10) Patent No.: US 7,210,911 B2
(45) Date of Patent: May 1, 2007

(54) CONTROLLER FOR VARIABLE DISPLACEMENT COMPRESSOR AND CONTROL METHOD FOR THE SAME

(75) Inventors: Masaki Ota, Kariya (JP); Masakazu Murase, Kariya (JP); Satoshi Umemura, Kariya (JP); Tatsuya Hirose, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 350 days.

(21) Appl. No.: 10/976,101

(22) Filed: Oct. 27, 2004

(65) Prior Publication Data

US 2005/0123409 A1 Jun. 9, 2005

(30) Foreign Application Priority Data

Oct. 27, 2003 (JP) ..... 2003-366124

(51) Int. Cl.
*F04B 1/26* (2006.01)

(52) U.S. Cl. ..... 417/53; 417/222.2; 62/228.3

(58) Field of Classification Search ..... 417/222.1, 417/222.2, 213, 307, 270; 62/228.1, 228.3, 62/228.4, 228.5, 226, 229
See application file for complete search history.

(56) References Cited

U.S. PATENT DOCUMENTS 6,510,702 B2 * 1/2003 Suitou et al. ..... 62/228.3
6,679,078 B2 * 1/2004 Yoshida et al. ..... 62/228.3
6,910,344 B2 * 6/2005 Matsubara et al. ..... 62/228.3
7,137,267 B2 * 11/2006 Murase et al. ..... 62/228.1
2004/0148947 A1 * 8/2004 Ota et al. ..... 62/84

FOREIGN PATENT DOCUMENTS

| | | |
|---|---|---|
| JP | 59-112156 | 6/1984 |
| JP | 10-318418 | 12/1998 |
| JP | 11-223183 | 8/1999 |
| JP | 2002-147351 | 5/2002 |

* cited by examiner

*Primary Examiner*—Michael Koczo, Jr.
*Assistant Examiner*—Vikansha Dwivedi
(74) *Attorney, Agent, or Firm*—Woodcock Washburn LLP

(57) ABSTRACT

A controller for a variable displacement compressor that maintains high displacement while preventing excessive increase in discharge pressure. The controller includes a pressure sensing mechanism for detecting pressure of a suction pressure region in the compressor. A suction pressure controlling means controls the displacement of the compressor so that the pressure detected by the pressure sensing mechanism is converged to a predetermined suction pressure setting. A sensor detects pressure of a discharge pressure region in the compressor. A discharge pressure controlling means controls the displacement of the compressor so that the pressure detected by the sensor is converged to a predetermined discharge pressure setting. When the pressure detected by the sensor is greater than a threshold pressure, an ECU switches the control of the compressor from control with the suction pressure controlling means to control with the discharge pressure controlling means.

12 Claims, 4 Drawing Sheets

CONTROLLER FOR VARIABLE DISPLACEMENT COMPRESSOR AND CONTROL METHOD FOR THE SAME

BACKGROUND OF THE INVENTION

The present invention relates to a variable displacement compressor that forms a refrigerating circuit of, for example, a vehicle air conditioner, and more particularly, to a controller for controlling displacement of a variable displacement compressor.

The refrigerant circuit of a typical air conditioner includes a gas cooler, an expansion valve, which functions as a depressurizing device, an evaporator, and a compressor. The compressor draws in refrigerant gas from the evaporator, compresses the refrigerant gas, and discharges the compressed gas to a gas cooler. The evaporator functions to perform heat exchange between the refrigerant flowing through the refrigerant circuit and the air in the passenger compartment. The heat transferred from the air that passes by the vicinity of the evaporator to the refrigerant flowing through the evaporator is in accordance with the level of the heating load or cooling load. Accordingly, the pressure of the refrigerant gas at the outlet and downstream side of the evaporator reflects the level of the cooling load in addition to the ambient temperature of the evaporator.

Variable displacement swash type compressors are often installed in automobiles. Such a compressor incorporates a displacement control mechanism that either maintains the ambient temperature of the evaporator at a predetermined target value (temperature setting) or maintains the pressure at the outlet of the evaporator (suction pressure) at a predetermined target value (suction pressure setting). To adjust the flow rate of the refrigerant in accordance with the cooling load, the displacement control mechanism feedback controls the displacement of the compressor, or the inclination angle of the swash plate, using the ambient temperature of the evaporator or the suction pressure as a control index.

A typical displacement control mechanism is a control valve referred to as an internal control valve. The internal control valve senses the suction pressure with a pressure sensing member, such as a bellows or a diaphragm. The pressure sensing member moves in accordance with the suction pressure. This, in turn, moves a valve body and adjusts the open amount of the valve. Accordingly, the internal control valve adjusts the pressure (crank pressure) of a swash plate chamber (crank chamber) so as to determine the swash plate angle.

A simple internal control valve using only one suction pressure setting cannot finely control the air conditioner. Japanese Laid-Open Patent Publication No. 10-318418 describes an example of a variable suction pressure setting control valve that solves this problem. An external device electrically controls this control valve to vary the suction pressure setting. The variable suction pressure setting control valve is formed by combining the above-described internal control valve with an actuator such as an electromagnetic solenoid that electrically adjusts an urging force. Accordingly, the variable suction pressure setting control valve is externally controlled to vary mechanical spring force that is applied to the pressure sensing member to determine the suction pressure setting of the internal control valve.

In the variable suction pressure setting control valve, when the actual suction pressure is not included in the range of the variable suction pressure setting (i.e., the range in which the suction pressure setting may be set), the valve body does not move even if the actual suction pressure changes or even if the suction pressure setting changes. For example, cool-down (rapid cooling) may be started in a state in which the actual suction pressure is greater than the variable suction pressure setting range. In such a case, the displacement of the compressor remains maximum until the actual suction pressure falls into the variable suction pressure setting range. The discharge pressure of the compressor increases when the compressor operates in the maximum displacement state. If the actual suction pressure is much greater than the variable suction pressure setting range when cool-down is started due to a high heating load or other reasons, the operation of the compressor in the maximum displacement state is prolonged. This excessively increases the discharge pressure.

Instead of using the above-described variable suction pressure setting control valve to control the displacement of the variable displacement compressor, a pressure sensor for detecting the suction pressure or a temperature sensor for detecting the ambient temperature of the evaporator may be used. More specifically, an external device controls the open amount of a control valve, which is an electromagnetic valve (electromagnetic actuator and valve body), so that the pressure detected by the pressure sensor becomes equal to the suction pressure setting or so that the temperature detected by the temperature sensor becomes equal to a predetermined temperature setting. In this case, however, the operation of the compressor in the maximum displacement state is also prolonged when the pressure detected by the pressure sensor is much greater than the suction pressure setting or when the temperature detected by the temperature sensor is much greater than the temperature setting.

Therefore, when controlling the displacement of the variable displacement compressor to adjust the cooling load by maintaining the ambient temperature of the evaporator at the temperature setting or by maintaining the suction pressure at the suction pressure setting, the discharge pressure may be excessively increased regardless of whether the control valve is controlled by an internal autonomous device or an external device.

Excessive increase of the discharge pressure affects the durability of each device and pipe in the refrigerant circuit. The refrigerant circuit normally includes a pressure relief valve (PRV). The PRV releases refrigerant out of the refrigerant circuit when the discharge pressure excessively increases, such as when a device does not function properly. In this manner, the PRV protects normally functioning devices and pipes. However, the PRV may be activated even though the compressor is functioning properly. In such a case, troublesome work, such as charging refrigerant, would be required for subsequent air-conditioning.

The discharge pressure is especially increased when using carbon dioxide as the refrigerant in comparison to when using, for example, FREON as the refrigerant. In this case, since the tolerance margin with respect to durability for the compressor and the pipes are small, the PRV has a tendency of being activated. Further, the critical temperature of the carbon dioxide refrigerant is low. Thus, the carbon dioxide refrigerant may be in a critical state when the ambient temperature is high, such as during the summer. In such a state, the discharge pressure of the carbon dioxide refrigerant tends to increase more suddenly and excessively, compared to a liquid refrigerant, when the compressor is operated in the maximum displacement state. Thus, the PRV would also have a tendency of being activated in this state.

When using, for example, a suction pressure setting variable control valve to control the displacement of a variable displacement compressor, the maximum value of the variable suction pressure setting range may be increased to solve the above problem. This would readily decrease the actual suction pressure to the variable suction pressure setting range without prolonging the operation of the compressor in the maximum displacement state during cool-down. If the actual suction pressure is in the variable suction pressure setting range, the sensing member functions to decrease the displacement of the compressor. This suppresses excessive increase of the discharge pressure.

However, the suction pressure is much higher when using a carbon dioxide refrigerant in comparison to when using a FREON refrigerant. Accordingly, when using a carbon dioxide refrigerant, the sensing member must be much smaller than that used for a FREON refrigerant to obtain the same displacement control characteristics. Nevertheless, it is presently difficult to make the sensing member more compact. For this reason, it is difficult to further widen the range of the variable suction pressure setting when using a carbon dioxide refrigerant.

SUMMARY OF THE INVENTION

The present invention provides a controller that suppresses excessive increase of the discharge pressure while maintaining the displacement of the variable displacement compressor at a high level.

One aspect of the present invention is a controller for a variable displacement compressor. The controller includes a cooling load detecting means for detecting cooling load. A cooling load controlling means controls displacement of the compressor so that the load detected by the cooling load detecting means is converged to a predetermined load setting. A discharge pressure detecting means detects the pressure of a discharge pressure. A discharge pressure controlling means controls the displacement of the compressor so that the pressure detected by the discharge pressure detecting means is converged to a predetermined discharge pressure setting. A switching means switches control of the compressor between the cooling load controlling means and the discharge pressure controlling means in accordance with the pressure detected by the discharge pressure detecting means. The switching means switches the control of the compressor from the cooling load controlling means to the discharge pressure controlling means when the pressure detected by the discharge pressure detecting means is greater than a threshold pressure, which is set greater than or equal to the discharge pressure setting.

A further aspect of the present invention is a method for controlling a variable displacement compressor. The method including detecting pressure of a suction pressure region, detecting pressure of a discharge pressure region, and controlling displacement of the compressor so that the pressure of the discharge pressure region is converged to a predetermined discharge pressure setting when the pressure of the discharge pressure region is greater than a threshold pressure, which is set greater than or equal to the discharge pressure setting, and so that the pressure of the suction pressure region is converged to a predetermined suction pressure setting when the pressure of the discharge pressure region is less than the threshold pressure.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A controller according to a preferred embodiment of the present invention will now be discussed. The controller controls a variable displacement compressor in a refrigerant circuit of an air conditioner for an automobile.

Figure 1:
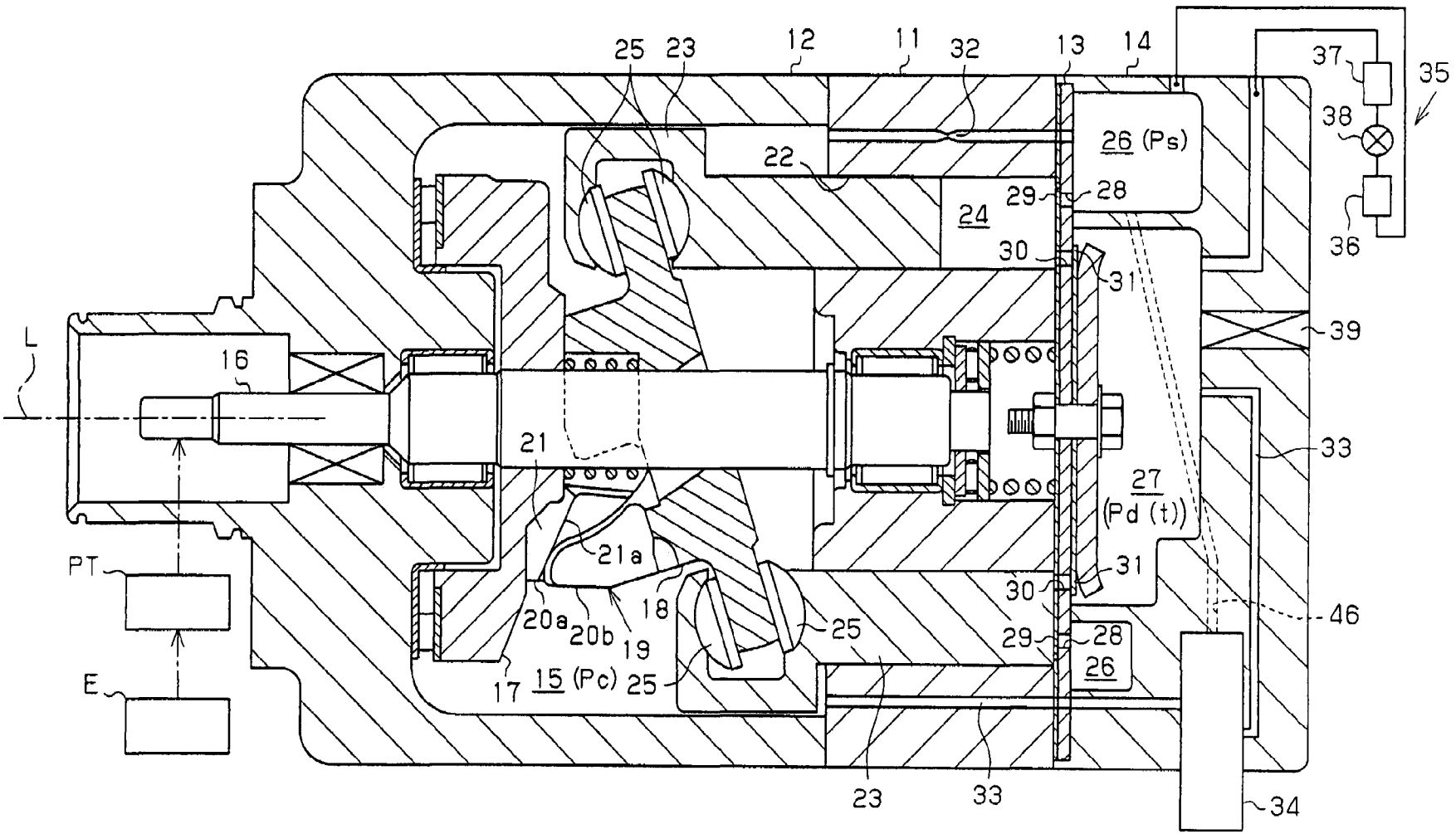
FIG. 1 is a cross-sectional diagram of a variable displacement compressor controlled by a controller according to a preferred embodiment of the present invention.

FIG. 1 is a cross-sectional view of the variable displacement compressor (hereinafter simply referred to as compressor). The left side as viewed in FIG. 1 will be described as the front side of the compressor, and the right side as viewed in FIG. 1 will be described as the rear side of the compressor. The compressor has a housing including a cylinder block 11, a front housing 12 fixed to the front end of the cylinder block 11, and a rear housing 14 fixed to the rear end of the cylinder block 11 with a valve plate 13 arranged therebetween.

A crank chamber 15 (control chamber) is defined in the compressor housing between the cylinder block 11 and the front housing 12. A drive shaft 16 extending through the crank chamber 15 is rotatably supported between the cylinder block 11 and the front housing 12. A clutchless (constant transmission) type power transmission mechanism PT connects the drive shaft. 16 to an engine E, which functions as a drive source of the vehicle. Accordingly, when the engine E is running, the drive shaft 16 is powered by the engine E and constantly rotated.

A rotor 17 is fixed to the drive shaft 16 in the crank chamber 15 to rotate integrally with the drive shaft 16. A generally disk-like swash plate 18, which functions as a cam plate, is accommodated in the crank chamber 15. The central portion of the swash plate 18 is fitted to the drive shaft 16 and supported so that the swash plate 18 rotates integrally with the drive shaft 16 in an inclinable manner. A hinge mechanism 19 is arranged between the rotor 17 and the swash plate 18.

The hinge mechanism 19 includes two rotor projections 20*a* (only one shown in FIG. 1), which extend from the rear surface of the rotor 17, and a swash plate projection 20*b*, which extends from the front surface of the swash plate 18 toward the rotor 17. The swash plate projection 20*b* has a distal end arranged between the two rotor projections 20*a*. Accordingly, the rotation force of the rotor 17 is transmitted to the swash plate 18 by the rotor projections 20*a* and the swash plate projection 20*b*.

The rotor projections 20*a* have a basal portion defining a cam 21. The rear end surface of the cam 21 defines a cam surface 21*a* facing towards the swash plate 18. The distal ends of the swash plate projections 20*b* are in contact with the cam surface 21*a* of the cam 21 in a slidable manner. Accordingly, the hinge mechanism 19 guides the inclination of the swash plate 18 so that the distal ends of the swash plate projections 20*b* move along the cam surface 21*a* of the cam 21 toward or away from the drive shaft 16.

A plurality of equally spaced cylinder bores 22 extend through the cylinder block 11 in the longitudinal direction (sideward as viewed in FIG. 1) about the axis L of the drive shaft 16. A single-headed piston 23 is retained and reciprocated in each cylinder bore 22. The cylinder bore 22 has a front opening closed by the piston 23 and a rear opening closed by the front side of the valve plate 13. A compression chamber 24 is defined in the cylinder bore 22. The reciprocation of the piston 23 in the cylinder bore 22 varies the volume of the compression chamber 24. Each piston 23 is connected to the swash plate 18 by a pair of shoes 25. Accordingly, rotation of the drive shaft 16 rotates the swash plate 18 and sways the swash plate 18 in the axial direction of the drive shaft 16. The swaying of the swash plate 18 reciprocates the pistons 23 back and forth.

A suction chamber 26 (suction pressure region) and a discharge chamber 27 (discharge pressure region) are defined in the compressor housing between the valve plate 13 and the rear housing 14. A suction port 28 and a suction valve 29 are formed in the valve plate 13 between each compression chamber 24 and the suction chamber 26. A discharge port 30 and a discharge valve 31 are formed in the valve plate 13 between each compression chamber 24 and the discharge chamber 27.

Carbon dioxide is used for the refrigerant of the refrigerant circuit. The refrigerant gas is drawn into the suction chamber 26 of the compressor from an evaporator 36 of an external refrigerant circuit 35, which forms the refrigerant circuit. Then, as each piston 23 moves from its top dead center position to its bottom dead center position, the refrigerant gas is drawn into the associated compression chamber 24 through the corresponding suction port 28 and suction valve 29. The refrigerant gas drawn into the compression chamber 24 is compressed to a predetermined pressure as the piston 23 moves from the bottom dead center position to the top dead center position and is then discharged into the discharge chamber 27 through the corresponding discharge port 30 and discharge valve 31. The refrigerant gas discharged into the discharge chamber 27 is sent to and cooled by a gas cooler 37 of the external refrigerant circuit 35. Subsequently, the refrigerant gas is depressurized by an expansion valve 38 and sent to an evaporator 36 to be vaporized.

A pressure relief valve (PRV) 39 having a known structure is arranged in the rear housing 14 and connected to the discharge chamber 27. The PRV 39 is activated to release the refrigerant out of the refrigerant circuit if discharge pressure Pd(t) excessively increases (e.g., to 16 MPa or greater) when, for example, a device in the refrigerant circuit fails to function properly. In this manner, the PRV 39 protects the normally functioning devices and pipes.

A displacement control mechanism of the compressor will now be described.

Referring to FIG. 1, a bleed passage 32, a gas supply passage 33, and a control valve 34 are provided in the compressor housing. The bleed passage 32 connects the crank chamber 15 to the suction chamber 26. The gas supply passage 33 connects the discharge chamber 27 to the crank chamber 15. The control valve 34 is arranged in the gas supply passage 33.

The open amount of the control valve 34 is adjusted to control the balance between the amount of high pressure discharge gas sent into the crank chamber 15 through the gas supply passage 33 and the amount of gas sent out of the crank chamber 15 through the bleed passage 32. This determines the internal pressure Pc of the crank chamber 15. As the internal pressure Pc of the crank chamber 15 changes, the difference between the internal pressure Pc of the crank chamber 15 and the internal pressure of the compression chambers 24 changes. This alters the angle of the inclination of the swash plate 18. As a result, the stroke of the pistons 23, or the displacement of the compressor 10, is varied.

For example, a decrease in the open amount of the control valve 34 decreases the internal pressure Pc of the crank chamber 15. This increases the inclination angle of the swash plate 18, lengthens the stroke of the pistons 23, and increases the displacement of the compressor. Conversely, an increase in the open amount of the control valve 34 increases the internal pressure Pc of the crank chamber 15. This decreases the inclination angle of the swash plate 18, shortens the stroke of the pistons 23, and decreases the displacement of the compressor.

The structure of the control valve 34 will now be described. The control valve 34 is configured to vary the suction pressure setting.

Figure 2A:
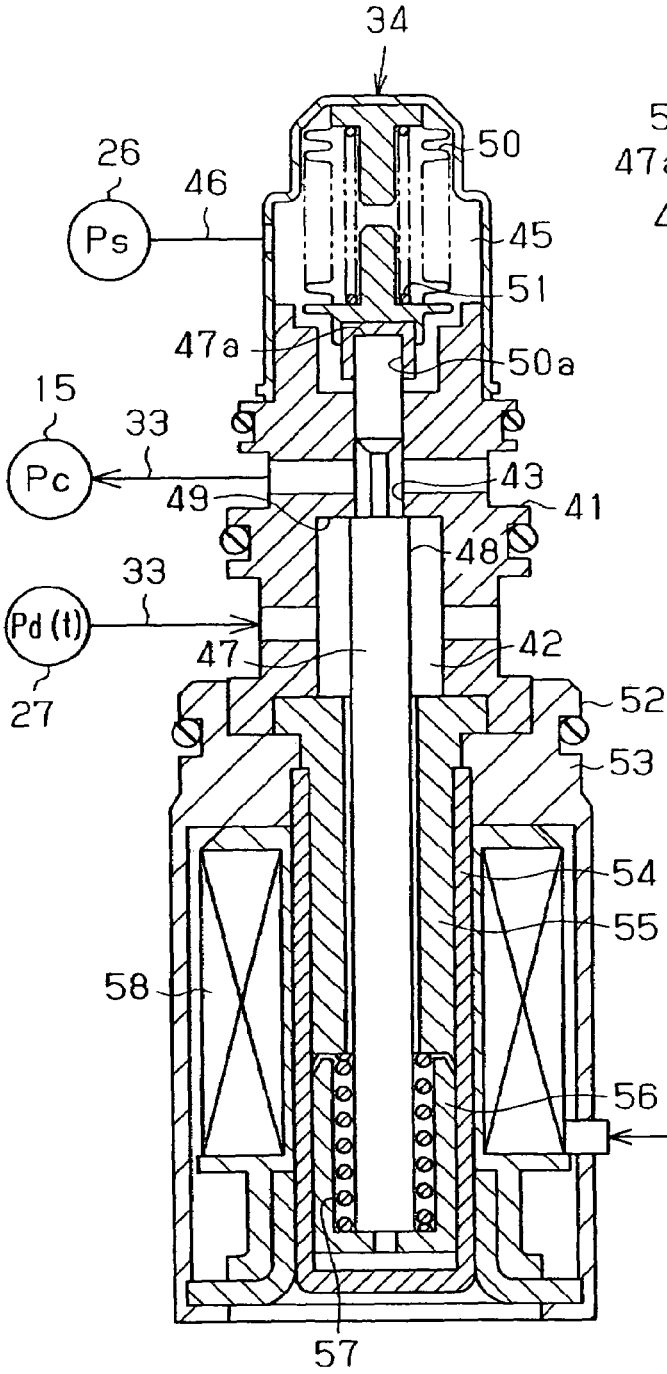
FIG. 2A is a cross-sectional diagram of a control valve in a first mode.

Referring to FIG. 2A, the control valve 34 includes a valve housing 41. A valve chamber 42, a communication passage 43, and a pressure sensing chamber 45 are defined in the valve housing 41. The valve chamber 42 is connected to the discharge chamber 27 through the upstream portion of the gas supply passage 33. The communication passage 43 is connected to the crank chamber 15 through the downstream portion of the gas supply passage 33. The valve chamber 42 and the communication passage 43 form a control valve interior passage of the gas supply passage 33. The pressure sensing chamber 45 is connected to the suction chamber 26 through a pressure sensing passage 46 extending through the rear housing 14. Accordingly, the pressure of the pressure sensing chamber 45 is equal to the pressure of the suction chamber 26 (suction pressure Ps).

A rod 47, which is movable in the axial direction, is arranged in the valve chamber 42 and the communication passage 43 of the valve housing 41. The rod 47 has an upper portion that disconnects the communication passage 43 from the pressure sensing chamber 45. Further, the rod 47 has a middle portion located in the valve chamber 42 and defines a valve body 48. A valve seat 49 is defined at the boundary between the valve chamber 42 and the communication passage 43. The upper end of the valve body 48 contacts the valve seat 49. Axial movement of the rod 47 alters the amount of the valve opening between the valve body 48 and the valve seat 49. This adjusts the open amount of the communication passage 43.

A pressure sensing member 50, which is formed by a bellows, is arranged in the pressure sensing chamber 45 of the valve housing 41. A socket 50*a* engaged with the upper end of the rod 47 is provided in the bottom portion of the pressure sensing member 50. A spring 51 is arranged in the pressure sensing member 50 to apply an urging force that expands the pressure sensing member 50. A pressure sensing mechanism of the control valve 34 includes the pressure sensing chamber 45, the pressure sensing member 50, and the spring 51. The pressure sensing mechanism functions as a suction pressure detecting means and a suction pressure controlling means.

The valve housing 41 has a lower portion, connected to an electromagnetic actuator 52 including a casing 53. A cylindrical sleeve 54, which has a closed bottom, is arranged in the center of the casing 53. A cylindrical fixed steel core 55 is secured to an upper portion of the sleeve 54. A lower portion of the rod 47 is inserted through the fixed steel core 55 in a movable manner. A movable steel core 56 is arranged in a lower portion of the sleeve 54 in a movable manner so that it contacts the fixed steel core 55 and moves away from the fixed steel core 55. The movable steel core 56 is integrally fixed to the lower end of the rod 47. A spring 57 is arranged in the sleeve 54 between the fixed steel core 55 and the movable steel core 56 to urge the movable steel core 56 away from the fixed steel core 55.

A coil 58 is wound around the sleeve 54 and across the fixed steel core 55 and the movable steel core 56. The coil 58 is connected to an air conditioner ECU 61, which configures a controller, by a valve drive circuit 62. The air conditioner ECU 61 supplies the coil 58 with drive current through the valve drive circuit 62. The air conditioner ECU 61 adjusts the voltage applied to the coil 58 when exciting the coil 58. In the preferred embodiment, the air conditioner ECU 61 controls the duty ratio of the current supplied to the coil 58 to adjust the voltage applied to the coil 58. Further, in the preferred embodiment, the air conditioner ECU 61 supplies the coil 58 with current having a high frequency (e.g., about 400 Hz) or current having a low frequency (e.g., about 15 Hz).

When the air conditioner ECU 61 supplies the control valve 34 with the high frequency current (drive current), relatively small vibrations are produced in the rod 47 during one cycle of the drive current due to the high frequency. In this case, the valve body 48 changes the valve open amount only slightly. Thus, the displacement of the compressor varies subtly.

Conversely, when the air conditioner ECU 61 supplies the control valve 34 with the low frequency current (drive current), the rod 47 moves a relatively large amount during one cycle of the drive current due to the low frequency. In this case, the valve body 48 changes the valve open amount a great amount and varies the displacement of the compressor. More specifically, when the air conditioner ECU 61 supplies the coil 58 with an ON signal (signal for exciting the coil 58) during one cycle of the low frequency drive current, electromagnetic attraction force (i.e., the force that moves the movable steel core 56 to the fixed steel core 55 with the magnetic flux penetrating the coil 58) becomes maximum. The electromagnetic attraction force remains maximum for a certain period of time and moves the rod 47 upward. As a result, the valve body 48 decreases the valve open amount and increases the displacement of the compressor. Further, when the air conditioner ECU 61 supplies the coil 58 with an OFF signal (signal for de-exciting the coil 58) during one cycle of the low frequency drive current, the electromagnetic attraction force is eliminated. The elimination of the electromagnetic attraction force for a certain period moves the rod 47 downward. As a result, the valve body 48 increases the valve open amount and decreases the displacement of the compressor.

Figure 2B:
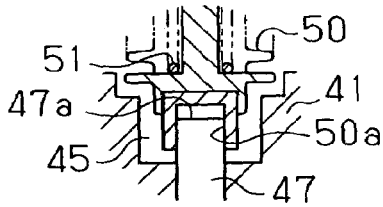
FIG. 2B is a cross-sectional diagram of a control valve in a second mode.
Figure 2B:
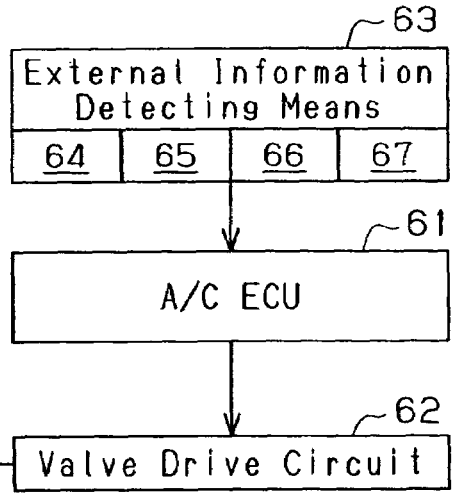

When the high frequency current is used as the drive current of the control valve 34 and the coil 58 is not excited (duty ratio Dt1=0%), the urging force of the spring 57, which urges the movable steel core 56, dominantly determines the position of the rod 47. Thus, the rod 47 moves to the lowermost position, and the top surface 47*a* of the rod 47 moves away from the inner surface in the socket 50*a* of the pressure sensing member 50 (as shown in the state of FIG. 2B). In this state, the valve body 48 of the rod 47 is separated from the valve seat 49 by the maximum distance to fully open the communication passage 43 without the movement of the pressure sensing member 50 effecting the position of the rod 47. As a result, the internal pressure Pc of the crank chamber 15 increases to the maximum value possible under the present circumstance. In this state, the inclination angle of the swash plate 18 is minimum. Thus, the displacement of the compressor is minimum. In such a state in which the coil 58 is not excited, the control valve 34 is in a second mode.

Further, when the coil 58 is supplied with high frequency current having a duty ratio that is greater than or equal to the minimum duty ratio DT1 (min) (>0) of a variable duty ratio range, the upward urging force applied to the movable steel core 56 overcomes the downward urging force of the spring 57. This starts the upward movement of the rod 47. Accordingly, as shown in the state of FIG. 2A, the top surface 47*a* of the rod 47 contacts the inner surface in the socket 50*a* of the pressure sensing member 50. Further, the spring 51 produces a force that expands the pressure sensing member 50. Thus, either one of the rod 47 and the pressure sensing member 50 follows the movement of the other one of the rod 47 and the pressure sensing member 50. That is, the rod 47 and the pressure sensing member 50 move integrally with each other.

In this manner, when the rod 47 and the pressure sensing member 50 are connected, an upward magnetic urging force, which is decreased by the lower urging force of the movable steel core urging spring 57, counters a downward pushing force, which is produced by the suction pressure Ps and increased by the downward urging force of the pressure sensing member urging spring 51. Accordingly, the control valve 34, which positions the rod 47 in accordance with changes in the actual suction pressure Ps, functions as an internal autonomous device that continuously maintains a control target for the suction pressure Ps (suction pressure setting) determined by the electromagnetic urging force. The duty ratio Dt1 is changed to adjust the electromagnetic urging force so that the suction pressure setting is variable between a maximum value corresponding to the minimum duty ratio DT1 (min) and a minimum value corresponding to the maximum duty ratio (duty ratio Dt1=100%). When the coil 58 is excited in a state greater than or equal to the minimum duty ratio Dt1(min), the control valve 34 is in a first mode.

When the air conditioner ECU 61 supplies the control valve 34 with the low frequency current (drive current), when the drive current is an OFF signal in one cycle of the drive current, the control valve 34 is in a state similar to the state in which the control valve 34 is excited at duty ratio Dt1=0% when the high frequency current is used as the drive current. Further, when the high frequency drive current is an ON signal in one cycle, the control valve 34 is in a state similar to the state in which the control valve 34 is excited at a duty ratio of Dt1=100% when the high frequency current is used as the drive current. That is, when the low frequency current is used as the drive current of the control valve 34, the first mode and the second mode of the control valve 34 are alternately repeated in accordance with a duty ratio Dt2 of the drive current (states excluding duty ratios of Dt2=0% and 100%). The control valve 34 substantially functions as an ON/OFF valve.

The controller of the compressor will now be described. The air conditioner ECU 61 is a computer-like control unit including a CPU, a ROM, a RAM, and an I/O interface. Referring to FIG. 2A, the I/O interface has an input terminal connected to an external information detecting means 63, which provides various types of external information, and an output terminal connected to the valve drive circuit 62.

Based on the various types of external information provided from the external information detecting means 63, the air conditioner ECU 61 selects either one of the high frequency current and the low frequency current that is more proper as the drive current of the control valve 34, calculates the duty ratio Dt1 and Dt2 of the drive current, and instructs the output of that drive current to the valve drive circuit 62. The valve drive circuit 62 supplies the coil 58 of the control valve 34 with the selected drive current.

The external information detecting means 63 is a function realizing means covering different types of sensors. The external information detecting means 63 includes an A/C switch 64 (ON/OFF switch of the air conditioner that is operated by a vehicle occupant), a temperature sensor 65 for detecting the passenger compartment temperature Te(t), a temperature setting device 66 for setting a preferable temperature setting Te(set) of the passenger compartment, and a discharge pressure sensor 67 (discharge pressure detecting means) for detecting the pressure (discharge pressure Pd(t)) of the discharge chamber 27.

Duty ratio control of the control valve 34, which is executed by the air conditioner ECU 61, will now be discussed with reference to the flowchart of FIGS. 3 to 5.

Figure 3:
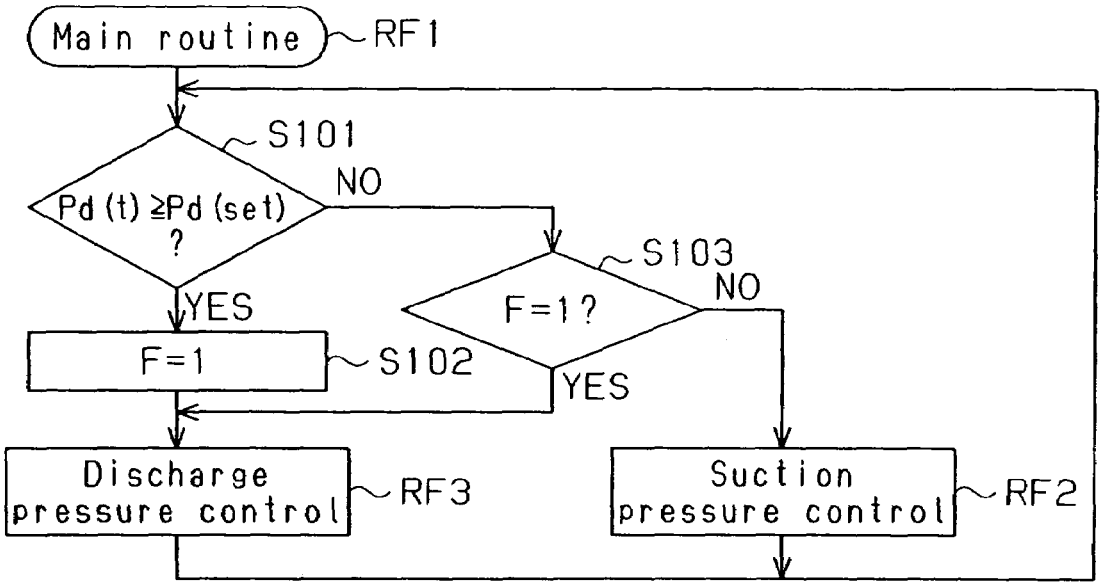
FIG. 3 is a flowchart illustrating a main routine.

Referring to FIG. 3, the air conditioner ECU 61 starts processing a main routine RF1, which functions as the core of an air conditioner control program, when the A/C switch 64 is turned ON. In step S101, the air conditioner ECU 61 determines whether the pressure Pd(t) detected by the discharge pressure sensor 67 is greater than or equal to a predetermined threshold pressure Pd(set). The threshold pressure Pd(set) is set lower than the activation pressure (16 MPa) of the PRV 39. More specifically, the threshold pressure Pd(set), which takes into consideration a certain margin for activation of the PRV 39, is set at, for example, 13 MPa.

When the determination of step S101 is YES, the air conditioner ECU 61 proceeds to step S102 and sets a flag F (F=1). The flag F is reset (F=0) when the processing of the main routine RF1 starts. Then, the air conditioner ECU 61 proceeds to a discharge pressure control routine RF3, which is shown in FIG. 5. If the determination of step S101 is NO, the air conditioner ECU 61 proceeds to step S103 and determines whether or not the flag F is set. When the determination of step S103 is YES, the air conditioner ECU 61 proceeds to the discharge pressure control routine RF3 of FIG. 5. If the determination of step S103 is NO, the air conditioner ECU 61 proceeds to a suction pressure control routine RF2, which is shown in FIG. 4.

In the suction pressure control routine RF2, for example, after the discharge pressure Pd(t) increases to greater than or equal to the threshold pressure Pd(set), the air conditioner ECU 61 proceeds to the discharge pressure control routine RF3. Conversely, in the discharge pressure control routine RF3, after the discharge pressure Pd(t) decreases to less than the threshold pressure Pd(set) and the flag F is reset, the air conditioner ECU 61 proceeds to the suction pressure control routine RF2. The air conditioner ECU 61, which functions as a switching means, processes the main routine RF1.

Figure 4:
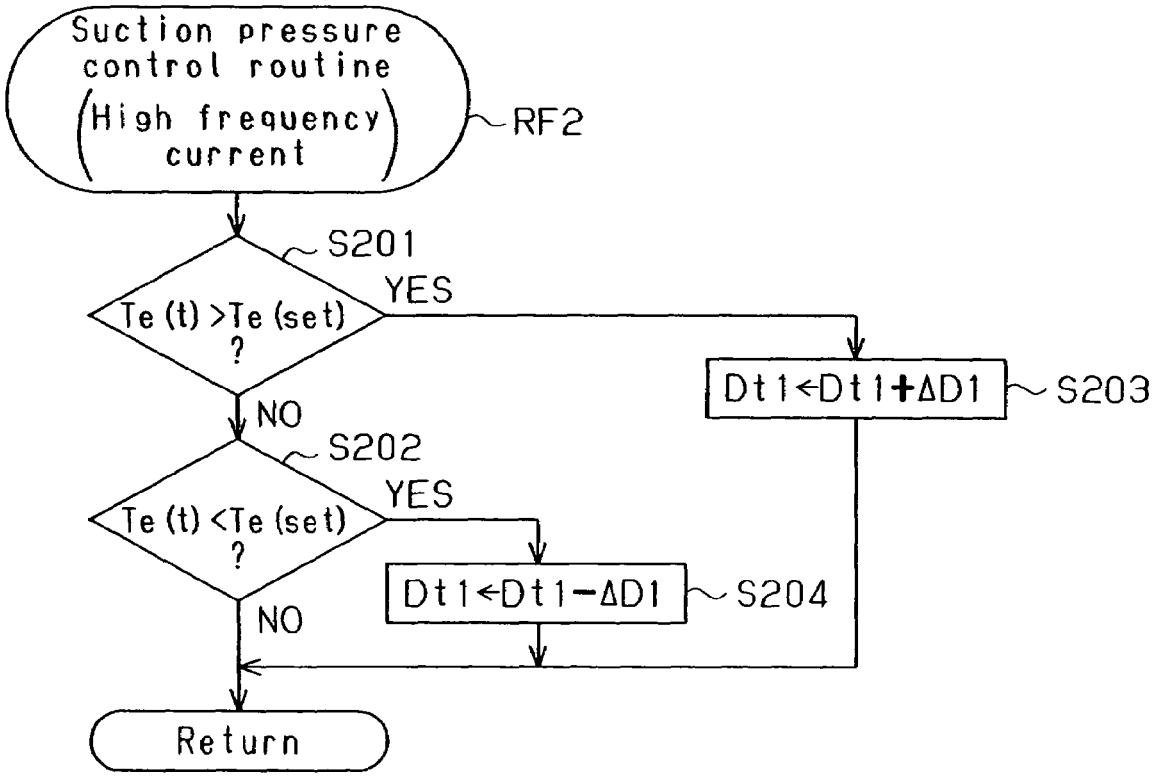
FIG. 4 is a flowchart illustrating a suction pressure control routine.

In the suction pressure control routine RF2, FIG. 4 illustrates the procedures related with the air conditioner capability for controlling the suction pressure Ps. When the processing proceeds to the suction pressure control routine RF2, the air conditioner ECU 61 selects the high frequency current as the drive current of the control valve 34. In step S201, the air conditioner ECU 61 determines whether or not the detected temperature Te(t) is greater than the temperature setting Te(set), which is set by the temperature setting device 66. If the determination is NO in step S201, the air conditioner ECU 61 proceeds to step S202 and determines whether or not the detected temperature Te(t) is less than the temperature setting Te(set). If the determination of step S202 is NO, the detected temperature Te(t) is substantially equal to the temperature setting Te(set). Thus, the air conditioner ECU 61 does not change the duty ratio Dt1, which adjusts the cooling capability.

When the determination of step S201 is YES, it is assumed that the passenger compartment is hot and the heating load is high. Thus, the air conditioner ECU 61 proceeds to step S203 to increase the duty ratio Dt1 by a unit amount ΔD1 and instruct the valve drive circuit 62 to change the duty ratio Dt1 to the corrected value Dt1+ΔD1. This slightly reduces the valve open amount of the control valve 34 and increases the displacement of the compressor. As a result, the heat elimination capacity of the evaporator 36 in the external refrigerant circuit 35 is increased, and the temperature Te(t) is decreased.

When the determination of step S202 is YES, it is assumed that the passenger compartment is cool and the heating load is low. Thus, the air conditioner ECU 61 proceeds to step S204 and decreases the duty ratio Dt1 by a unit amount ΔD1 and instructs the valve drive circuit 62 to change the duty ratio Dt1 to the corrected value Dt1−ΔD1. This slightly increases the valve open amount of the control valve 34 and decreases the displacement of the compressor. As a result, the heat elimination capacity of the evaporator 36 in the external refrigerant circuit 35 is decreased, and the temperature Te(t) is increased. In step S204, the air conditioner ECU 61 decreases the duty ratio Dt1 within a range in which the minimum duty ratio Dt1(min) is the lower limit. In other words, the control valve 34 is maintained in the first mode.

In this manner, the air conditioner ECU 61 corrects the duty ratio Dt1 in step S203 and/or step S204 to gradually optimize the duty ratio Dt1 even if the detected temperature Te(t) is deviated from the temperature setting Te(set). Further, the internal autonomous adjustment of the valve open amount in the control vale 34 converges the temperature Te(t) to a value close to the temperature setting Te(set).

Figure 5:
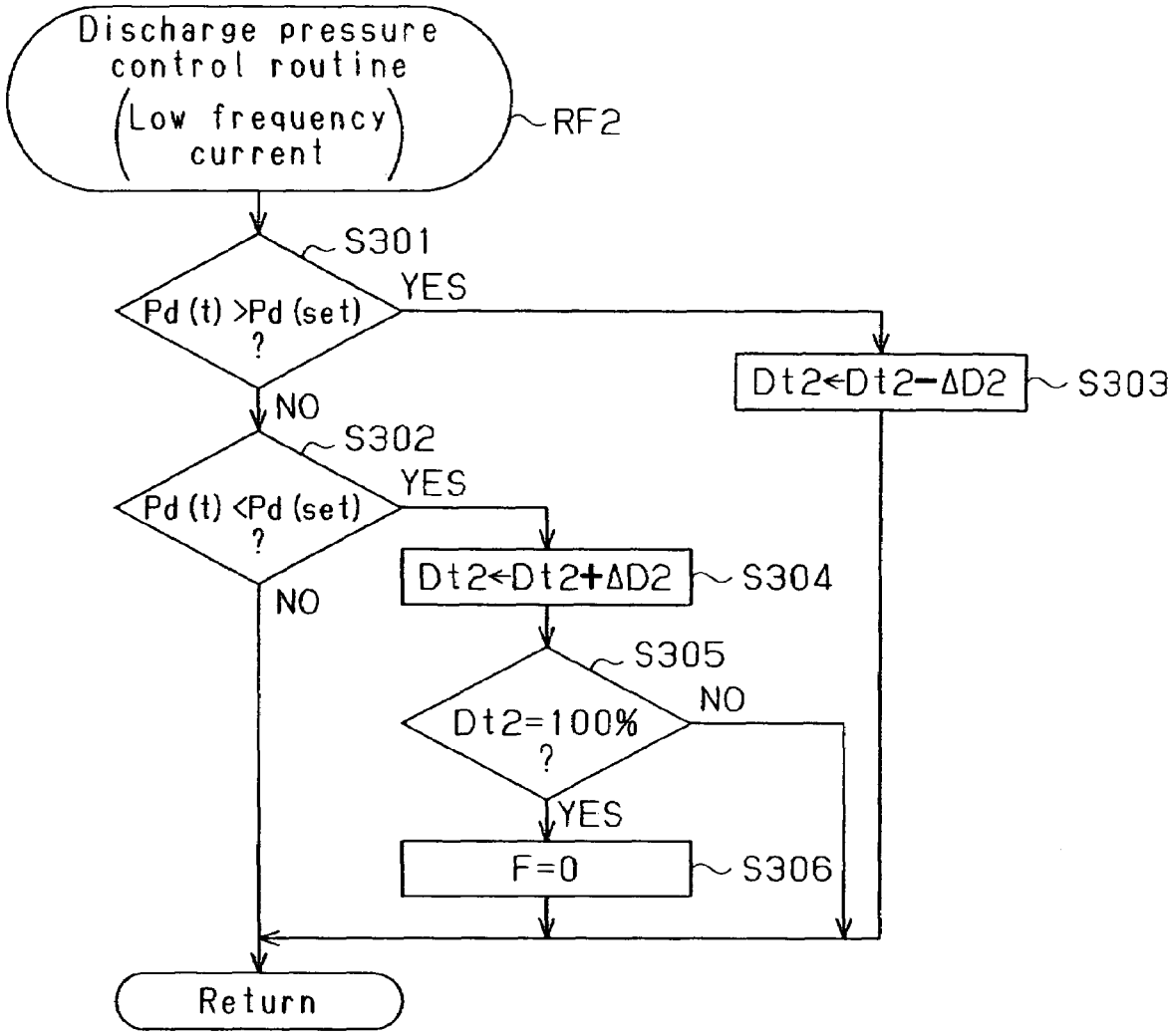
FIG. 5 is a flowchart illustrating a discharge pressure control routine.

In the discharge pressure control routine RF3, the procedures related with the air conditioning capability for controlling the discharge pressure Pd(t) is illustrated in FIG. 5. In the discharge pressure control routine RF3, the air conditioner ECU 61 selects the low frequency current as the drive current of the control valve 34. In step S301, the air conditioner ECU 61 determines whether or not the detected discharge pressure Pd(t) is greater than the threshold pressure Pd(set), which is a discharge pressure setting. When the determination of step S301 is NO, in step S302, the air conditioner ECU 61 determines whether or not the detected discharge pressure Pd(t) is less than the threshold pressure Pd(set). When the determination of step S302 is NO, the detected pressure Pd(t) is substantially equal to the threshold pressure Pd(set). Thus, the air conditioner ECU 61 does not change the duty ratio Dt2, which would lead to a change in the discharge pressure Pd(t).

When the determination of step S301 is YES, in step S303, the air conditioner ECU 61 decreases the duty ratio Dt2 by a unit amount ΔD2 and instructs the valve drive circuit 62 to change the duty ratio Dt2 to the corrected value Dt1−ΔD2. Accordingly, the ratio of the control valve 34 in the first mode for one cycle of the drive current slightly decreases, while the ratio of the second mode slightly increases. As a result, the average displacement of the compressor for one cycle decreases and lowers the discharge pressure Pd(t).

When the determination of step S302 is YES, in step S304, the air conditioner ECU 61 increases the duty ratio Dt2 by a unit amount ΔD2 and instructs the valve drive circuit 62 to change the duty ratio Dt2 to the corrected value Dt1+ΔD2. Accordingly, the ratio of the control valve 34 in the first mode for one cycle of the drive current slightly increases, while the ratio of the second mode slightly decreases. As a result, the average displacement of the compressor for one cycle increases and raises the discharge pressure Pd(t). In step S305, the air conditioner ECU 61 determines whether the duty ratio Dt2 is maximum, or 100%. In other words, the air conditioner ECU 61 determines whether it can be assumed that the displacement of the compressor is maximum.

In a state in which the discharge pressure Pd(t) is less than the threshold pressure Pd(set) when the displacement is maximum, the discharge pressure Pd(t) does not become greater than or equal to the threshold pressure Pd(set) even if the suction pressure control routine RF2 is executed. Accordingly, when the determination of step S305 is YES, the air conditioner ECU 61 resets the flag F in step S306. When the flag F is reset, the determination given by the air conditioner ECU 61 is NO in step S103 of the main routine RF1 illustrated in FIG. 3. Thus, the air conditioner ECU 61 switches the processing from the discharge pressure control routine RF3 to the suction pressure control routine RF2. When the determination of step S305 is NO, the flag F is not reset. Since the flag F remains set, the determination of the air conditioner ECU 61 for step S103 in the main routine RF1 of FIG. 3 is YES. Accordingly, the air conditioner ECU 61 continues the discharge pressure control routine RF3 even if the discharge pressure Pd(t) is less than the threshold pressure Pd(set).

As described above, the air conditioner ECU 61 gradually optimizes the duty ratio Dt2 by correcting the duty ratio Dt2 in step S303 and/or step S304 even if the detected pressure Pd(t) is deviated from the threshold voltage Pd(set). Accordingly, the detected pressure Pd(t) is converged to a value close to the threshold pressure Pd(set). In this manner, the air conditioner ECU 61 functions as a discharge pressure controlling means to process the discharge pressure control routine RF3.

The controller of the first embodiment has the advantages described below.

(1) When the displacement of the compressor remains high due to the cool-down demand when, for example, the compressor is controlled in the suction pressure control routine RF2, the discharge pressure Pd(t) may exceed the threshold pressure Pd(set). In such a state, the air conditioner ECU 61 included in the controller of the first embodiment switches the control of the compressor from the suction pressure control routine RF2 to the discharge pressure control routine RF3. In this manner, the air conditioner ECU 61 maintains the high displacement of the compressor, or the high cooling capacity of the refrigerant circuit, while suppressing excessive increase of the discharge pressure Pd(t). Accordingly, the controller of the preferred embodiment optimally performs cool-down and prevents the PRV 39 from being activated when the compressor is functioning normally.

(2) When the discharge pressure Pd(t) is less than the threshold pressure Pd(set) and the displacement of the compressor is maximum, the discharge pressure Pd(t) does not become greater than or equal to the threshold pressure Pd(set) even if the compressor is controlled in the suction pressure control routine RF2. In this case, the air conditioner ECU 61 switches the control of the compressor from the discharge pressure control routine RF3 to the suction pressure control routine RF2. Accordingly, a state in which the discharge pressure Pd(t) becomes greater than or equal to the threshold pressure Pd(set) immediately after switching the control is avoided. That is, a state is avoided in which hunting occurs and switches the control of the compressor back to the discharge pressure control routine RF3.

(3) The control valve 34, which mechanically detects the suction pressure Ps, moves the rod 47 (valve body 48) so as to offset changes in the detected pressure Ps and adjusts the valve open amount in an internally autonomous manner. In the prior art, the size of the pressure sensing member 50 must be reduced to increase the upper limit of the range of the variable suction pressure setting and prevent excessive increase of the discharge pressure Pd(t). However, as described in the BACKGROUND OF THE INVENTION, the reduction of the size of the pressure sensing member 50 when employing a carbon dioxide refrigerant is presently difficult. In the preferred embodiment, excessive increase of the discharge pressure Pd(t) is prevented using the control valve 34, which has the same structure as that of the prior art, without reducing the size of the pressure sensing member 50. That is, the controller of the preferred embodiment enables employment of the carbon dioxide refrigerant while providing these advantages.

(4) In the discharge pressure control routine RF3, when the pressure Pd(t) detected by the discharge pressure sensor 67 is greater than the threshold pressure Pd(set), the air conditioner ECU 61 gradually decreases the ratio the control valve 34 is in the first mode in one cycle of the drive current (step S303). In this manner, the air conditioner ECU 61 fixes the control valve 34 in the second mode when the pressure Pd(t) detected by the discharge pressure sensor 67 is greater than the threshold voltage Pd(set). When the detected pressure Pd(t) is less than the threshold pressure Pd(set), the air conditioner ECU 61 gradually increases the ratio the control valve 34 is in the first mode in one cycle of the drive current (step S304). In this manner, when the pressure Pd(t) detected by the discharge pressure sensor 67 is less than the threshold voltage Pd(set), the air conditioner ECU 61 further suppresses sudden and excessive change in the displacement of the compressor in comparison to when the control valve 34 is fixed in the first mode. The controller of the preferred embodiment sets the first and second modes in this manner. Thus, the discharge pressure Pd(t) is easily converged to a value close to the threshold pressure Pd(set). Accordingly, the controller of the preferred embodiment keeps the compressor displacement high while suppressing excessive increase of the discharge pressure Pd(t).

(5) Carbon dioxide is used as the refrigerant of the refrigerant circuit. In comparison to when using a FREON refrigerant, the discharge pressure Pd(t) has a tendency of increasing suddenly and excessively when using a carbon dioxide refrigerant. Accordingly, since the controller of the preferred embodiment is applied to a compressor that compresses carbon dioxide, advantages (1) to (4) are further prominent.

It should be apparent to those skilled in the art that the present invention may be embodied in many other specific forms without departing from the spirit or scope of the invention. Particularly, it should be understood that the present invention may be embodied in the following forms.

In the preferred embodiment, the suction pressure detecting means and the suction pressure controlling means include the pressure sensing mechanism (pressure sensing member 50, etc.) incorporated in the control valve 34. Instead, a suction pressure sensor that detects the suction pressure Ps may function as the suction pressure detecting means, and the air conditioner ECU 61 may function as the suction pressure controlling means. More specifically, the air conditioner ECU 61 may control the valve open amount of a control valve, which is formed by an electromagnetic valve (electromagnetic actuator and valve body) so that the detected pressure of the suction pressure sensor becomes equal to a predetermined suction pressure setting. In this case, the suction pressure setting may be constant or may be varied in accordance with the cooling load like in the preferred embodiment.

In the preferred embodiment, the suction pressure detecting means and the suction pressure controlling means include the pressure sensing mechanism (pressure sensing member 50 etc.) incorporated in the control valve 34. Instead, the temperature sensor 65 detecting the temperature Te(t) may function as the cooling load detecting means, and the air conditioner ECU 61 may function as the cooling load controlling means. More specifically, the air conditioner ECU 61 may control the valve open amount of a control valve, which is formed by an electromagnetic valve (electromagnetic actuator and valve body) so that the temperature detected by the temperature sensor 65 becomes equal to the temperature setting Te(Set).

In the preferred embodiment, the control target (discharge pressure setting) in the discharge pressure control routine RF3 is set to the threshold pressure Pd(set) used in the determination of step S101 in the main routine RF1. Instead, the control target (discharge pressure setting) may be set to a pressure that is lower than the threshold pressure Pd(set) by 5% to 20%.

In the control valve of the preferred embodiment, the control valve 34 is a so-called suction side control valve, which adjusts the open amount of the gas supply passage 33. Instead, the control valve may be a so-called discharge side control valve, which adjusts the open amount of the bleed passage 32.

In the preferred embodiment, if the discharge pressure Pd(t) is less than the threshold pressure Pd(set) and the displacement of the compressor is maximum (or presumed to be maximum), the air conditioner ECU 61 switches the control of the compressor from the discharge pressure control routine RF3 to the suction pressure control routine RF2.

Alternatively, for example, if the compressor is controlled in the discharge pressure control routine RF3 continuously for a predetermined time, the air conditioner ECU 61 may switch the control of the compressor from the discharge pressure control routine RF3 to the suction pressure control routine RF2. Continuous control of the compressor in the discharge pressure control routine RF3 for a predetermined time significantly decreases the suction pressure Ps. In this state, it may be determined that the discharge pressure Pd(t) does not become greater than or equal to the threshold pressure Pd(set) when the compressor is controlled in the suction pressure control routine RF2.

In the preferred embodiment, the air conditioner ECU 61 switches the control of the compressor from the discharge pressure control routine RF3 to the suction pressure control routine RF2 when the discharge pressure Pd(t) is less than the threshold voltage Pd(set) and the displacement of the compressor is maximum (or presumed to be maximum). Instead, the air conditioner ECU 61 may switch the control of the compressor from the discharge pressure control routine RF3 to the suction pressure control routine RF2 when the discharge voltage Pd(t) becomes less than a pressure setting that is set to a value lower than the threshold pressure Pd(set).

In the preferred embodiment, the air conditioner ECU 61 switches the control of the compressor from the discharge pressure control routine RF3 to the suction pressure control routine RF2 when the discharge pressure Pd(t) is less than the threshold pressure (pd(set) and the displacement of the compressor is maximum. In addition, the air conditioner ECU 61 may switch the control of the compressor from the discharge pressure control routine RF3 to the suction pressure control routine RF2 regardless of the discharge pressure Pd(t) and the displacement when the discharge pressure Pd(t) is decreased by change in a parameter, such as decrease in the speed of the engine E (i.e., the rotation speed of the compressor) or decrease in the rotation speed of a blower motor, which controls the air flow amount.

In the discharge control routine RF3 of the preferred embodiment, the air conditioner ECU 61 gradually decreases the ratio that the control valve is in the first mode in one cycle of the drive current (step S303) when the detected pressure Pd(t) of the discharge pressure sensor 67 is greater than the threshold pressure Pd(set) (step S304). The air conditioner ECU 61 gradually increases the ratio at which the control valve 34 is set in the first mode in one cycle of the drive current when the detected pressure Pd(t) is less than the threshold pressure Pd(set). Instead, the air conditioner ECU 61 may fix the control valve 34 in the second mode when the detected pressure Pd(t) of the discharge pressure sensor 67 is greater than the threshold pressure Pd(set). Conversely, the air conditioner ECU 61 may fix the control valve 34 in the first mode when the detected pressure Pd(t) is less than the threshold pressure Pd(set). In this case, the air conditioner ECU 61 switches control from the discharge pressure control routine RF3 to the suction pressure control routine RF2 after the discharge pressure control routine RF3 is continued over a predetermined time.

The controller of the preferred embodiment adjusts the internal pressure Pc of the crank chamber 15, which connects the suction chamber 26 to the discharge chamber 27, to control the displacement of the compressor. Instead, an actuator, such as a fluidal pressure cylinder connected to the swash plate 18, may be used to control the displacement of the compressor. More specifically, the actuator may be externally controlled so that the controller adjusts the inclination angle of the swash plate 18, that is, the displacement of the compressor.

The present invention may be applied to a controller used for a wobble type variable displacement compressor.

The present invention may be applied to a variable displacement compressor that does not use pistons.

The present invention may be applied to a variable displacement compressor that is not used in a refrigerant circuit.

The present examples and embodiments are to be considered as illustrative and not restrictive, and the invention is not to be limited to the details given herein, but may be modified within the scope and equivalence of the appended claims.

What is claimed is:

1. A controller for a variable displacement compressor, the controller comprising:

a cooling load detecting means for detecting cooling load;

a cooling load controlling means for controlling displacement of the compressor so that the load detected by the cooling load detecting means is converged to a predetermined load setting;

a discharge pressure detecting means for detecting the pressure of a discharge pressure region;

a discharge pressure controlling means for controlling the displacement of the compressor so that the pressure detected by the discharge pressure detecting means is converged to a predetermined discharge pressure setting; and a switching means for switching control of the compressor between the cooling load controlling means and the discharge pressure controlling means in accordance with the pressure detected by the discharge pressure detecting means, wherein the switching means switches the control of the compressor from the cooling load controlling means to the discharge pressure controlling means when the pressure detected by the discharge pressure detecting means is greater than a threshold pressure, which is set greater than or equal to the discharge pressure setting.

2. The controller according to claim 1, wherein the cooling load detecting means is a suction pressure detecting means for detecting pressure of a suction pressure region as the cooling load; and the cooling load controlling means is a suction pressure controlling means for controlling displacement of the compressor so that the pressure detected by the suction pressure detecting means is converged to a predetermined suction pressure setting as the predetermined load setting.

3. The controller according to claim 2, wherein the switching means switches the control of the compressor, when the discharge pressure controlling means is controlling the compressor, from the discharge pressure controlling means to the suction pressure controlling means if the pressure detected by the discharge pressure detecting means is less than the threshold pressure and the displacement of the compressor is maximum.

4. The controller according to claim 2, wherein the compressor includes:

a control chamber communicating the suction pressure region and the discharge pressure region with one another; and a control valve for adjusting pressure of the control chamber with the suction pressure controlling means and the discharge pressure controlling means to control the displacement of the compressor, wherein the control valve includes;

a valve body; and a pressure sensing mechanism for mechanically detecting the pressure of the suction pressure region to adjust a valve open amount of the control valve with the valve body and vary the displacement of the compressor, the pressure sensing mechanism being formed by the suction pressure detecting means and at least part of suction pressure controlling means;

wherein the control valve functions in a control mode that is switchable between a first mode for validating a valve open amount adjustment with the pressure sensing mechanism and a second mode for invalidating the valve open amount adjustment and minimizing displacement of the compressor;

the suction pressure controlling means adjusting the valve open amount of the control valve when the control valve is maintained in the first mode; and the discharge pressure controlling means adjusting the valve open amount of the control valve by alternately switching the control valve between the first mode and the second mode.

5. The controller according to claim 4, wherein the discharge pressure controlling means gradually decreases the rate the control mode of the control valve is set in the first mode during a unit of time when the pressure detected by the discharge pressure detecting means is greater than the discharge pressure setting, and the discharge pressure controlling means gradually increases the rate the control mode of the control valve is set in the first mode during the unit of time when the pressure detected by the discharge pressure detecting means is less than the discharge pressure setting.

6. The controller according to claim 4, wherein:

the control valve includes a coil connected to the suction pressure controlling means and the discharge pressure controlling means, the coil moving the valve body so that the pressure detected by the discharge pressure controlling means increases when supplied with current;

the suction pressure controlling means supplying the coil with current having a first frequency; and the discharge pressure controlling means supplying the coil with current having a second frequency that is lower than the first frequency.

7. The controller according to claim 1, wherein the compressor forms part of a refrigerant circuit that uses refrigerant including carbon dioxide.

8. The controller according to claim 1, wherein the compressor includes a pressure relief valve having an activation pressure, the threshold pressure is set to a value lower than the activation pressure of the pressure relief valve.

9. A method for controlling a variable displacement compressor, the method comprising the steps of:

detecting pressure of a suction pressure region;

detecting pressure of a discharge pressure region; and controlling displacement of the compressor so that the pressure of the discharge pressure region is converged to a predetermined discharge pressure setting when the pressure of the discharge pressure region is greater than a threshold pressure, which is set greater than or equal to the discharge pressure setting, and so that the pressure of the suction pressure region is converged to a predetermined suction pressure setting when the pressure of the discharge pressure region is less than the threshold pressure.

10. The method according to claim 9, further comprising:

controlling the displacement of the compressor so that the pressure of the suction pressure region is converged to the predetermined suction pressure setting when the pressure of the discharge pressure region is less than the threshold pressure and the displacement of the compressor is maximum.

11. The method according to claim 9, wherein the compressor is used in air conditioning for a passenger compartment in a vehicle having a thermostat for setting a maximum temperature at which the passenger compartment is to be maintained, said method further comprising:

detecting the temperature of said compartment, and if the temperature detected is greater than the maximum temperature, in said controlling displacement of the compressor in accordance with the pressure of the suction pressure region, the displacement is increased.

12. The method according to claim 9, wherein the compressor is used in air conditioning for a passenger compartment in a vehicle having a thermostat for setting a maximum temperature at which the passenger compartment is to be maintained, said method further comprising:

detecting the temperature of said compartment, and if the temperature detected is less than the maximum temperature, in controlling displacement of the compressor in accordance with the pressure of the suction pressure region, the displacement is decreased.

* * * * *